United States Patent [19]

Caruel et al.

[11] 4,329,848

[45] May 18, 1982

[54] COOLING OF COMBUSTION CHAMBER WALLS USING A FILM OF AIR

[75] Inventors: Jacques E. J. Caruel, Maincy; Philippe M. D. Gastebois; Simone Coutor, both of Melun, all of France

[73] Assignee: Societe Nationale d'Etude et de Construction de Moteurs d'Aviation, Paris, France

[21] Appl. No.: 125,915

[22] Filed: Feb. 29, 1980

[30] Foreign Application Priority Data

Mar. 1, 1979 [FR] France ..... 79 05317

[51] Int. Cl.[3] ..... F23R 3/08

[52] U.S. Cl. ..... 60/757

[58] Field of Search ..... 60/756, 757

[56] References Cited

U.S. PATENT DOCUMENTS

| | | | |
|---|---|---|---|
| 3,737,152 | 6/1973 | Wilson | 60/757 |
| 3,826,082 | 7/1974 | Smuland et al. | 60/757 |
| 3,845,620 | 11/1974 | Kenworthy | 60/757 |
| 3,995,422 | 12/1976 | Stamm | 60/757 |
| 4,109,459 | 8/1978 | Ekstedt et al. | 60/757 |

FOREIGN PATENT DOCUMENTS 2112220 6/1972 France .

OTHER PUBLICATIONS

Wahl, D., et al. *Brennstoff-Waerme-Kraft*, vol. 27, No. 5, May, 1975, pp. 201-205.

*Primary Examiner*—Robert E. Garrett

*Attorney, Agent, or Firm*—Oblon, Fisher, Spivak, McClelland & Maier

[57] ABSTRACT

A device for cooling the wall of a combustion chamber, in which air is taken from the space outside the chamber by means of an annular protuberance which extends beyond the outside of the chamber and forms an annular pocket, which is provided with outside air by means of holes and communicates with the interior of the chamber by means of an annular slot between the downstream internal wall of the chamber and a small annular tongue which is an extension of the upstream wall. The air intake holes for the pocket are arranged in the wall of the protuberance which is more or less perpendicular to the wall of the chamber which faces the air flow and have a sufficiently small diameter to make it possible to arrange them in at least three concentric rows, which are offset from one row to the next.

4 Claims, 3 Drawing Figures

COOLING OF COMBUSTION CHAMBER WALLS USING A FILM OF AIR

BACKGROUND OF THE INVENTION

1. Field of the Invention

The invention concerns combustion chambers of the type used mainly in aviation turbojets, which are intended for ensuring the combustion of a fuel in a high-pressure air flow. These chambers consist of a wall, called the flame tube, arranged lengthwise in the air flow and provided with a cooling device which includes measures for forming a film of air on the internal surface of the wall so as to protect it from the direct action of the flame. This cooling procedure is known under the name of "film cooling."

The major problem posed by this procedure is that of sufficiently slowing down the cooling air to a desired velocity equal to the speed of the hot gasses, thereby enabling the cooling air to flow along the internal surface of the wall to be cooled while forming a uniform film over it.

2. Description of the Prior Art

It has previously been proposed to have the air enter through a number of small holes made in a part of the wall to be cooled which is flared in shape; it is thought that in this way there will be rapid slackening in the speed of the small streams of air passing through the holes.

Moreover, it is known that the permeability of a surface perforated in many places is slight.

It has also been proposed to add, to the combustion chamber tube flame wall, annular shoulders which make up sorts of annular pockets, regularly spaced longitudinally and separated from the interior of the flame tube by a portion of the wall or a small tongue which is oriented axially, and to introduce the cooling air in these pockets, from which it comes out in an axial direction across the slot which exists between the small tongue and the flame tube. But, in this earlier proposal, the holes being used as air intakes in each of these pockets were not numerous and were relatively large in diameter, so that within the pockets the slackening of speed was not carried out properly unless a small tongue with a substantial axial length was provided, which constitutes a problem because the small tongue, in that it is exposed to extreme thermal constraints, threatens to become disfigured in a manner prejudicial to the effectiveness of the air film.

In order to shorten the small tongue, it has of course been proposed to provide intake orifices in the pocket is such a way that the flow of cold air must be reversed before it leaves the pocket, or even to provide a baffle in the pocket. These solutions give rise to problems, however, by creating harmful turbulence.

SUMMARY OF THE INVENTION

The present invention concerns an annular protuberance and pocket, and its purpose is the refinement represented by having the orifices used for air intake into the pocket arranged in the part of the wall of the protuberance which is opposite the flow of the air and is more or less perpendicular to the wall of the combustion chamber, and having such orifices be small in diameter and repeated in at least three circular rows, with each row staggered in relation to the others.

Tests have shown that this particular combination makes it possible to obtain, despite the axial nature of the flow of the air jets through the entry orifices, rapid slackening of their speed in the pocket and a rapid regrouping of these small air streams in close proximity into one homogeneous flow, which promotes the possibility, of obtaining good thermal efficiency without requiring excessive length of the small tongue. The latter may be ended at the right-angle connection point of the protuberance with the combustion chamber wall. In addition, arrangement of the orifices in a part of the wall which is more or less perpendicular to the direction of the air flow, and is higher than the thickness of the film to be created, makes it possible to correct for the mediocre permeability level which a multiperforated wall generally has. In this context, "part of the wall which is more or less perpendicular" should be understood to mean that the angle that part makes with the wall of the flame tube is between 70 and 90 degrees.

It should be noted that the convection exchanges through the orifices play a role in the cooling of the flame tube wall at a location which is particularly subject to thermal constraints and, finally, that the great height of the protuberance gives the combustion chamber a structural inertia which is very important, particularly for large diameter combustion chambers in motors with a high pressure ratio.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
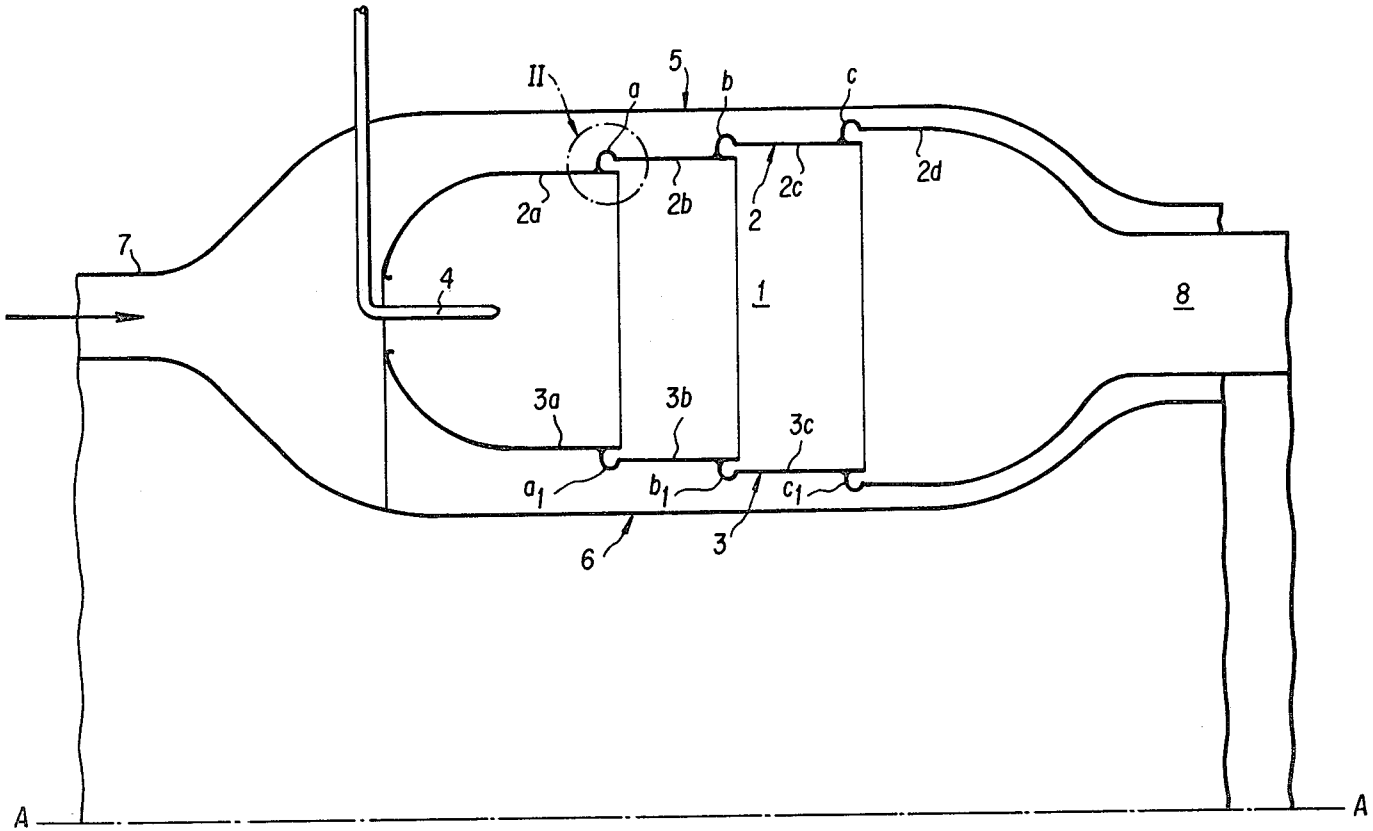
FIG. 1 is a schematic view in axial cross section of a combustion chamber of a turbojet involving the application of the invention.

The combustion chamber represented in FIG. 1 is of the annular type used in certain turbojets, i.e., the combustion space or flame tube 1 is in the form of a ring revolving around the axis A—A and delimited by two coaxial surfaces 2 and 3 which are substantially cylindrical in form and are made of successive sheet-metal sleeves; but the invention could be applied just as well in a tubular chamber.

Combustion of the fuel, which is introduced by means of the injectors 4 arranged in a crown pattern around the axis A—A, takes place in the annular combustion chamber 1.

The annular combustion chamber 1 itself is contained within an annular space which is also revolving around axis A—A and is delimited by coaxial surfaces 5 and 6.

The air under pressure, from the compressor (not shown), enters the annular space between 5 and 6 at point 7 in such a way that the flame tube defined by walls 2 and 3 is bathed by the air filling said space.

Part of the air enters the flame tube 1 by passing around the injectors 4 to enable combustion of the injected fuel.

Air may also penetrate the flame tube at other places scattered over it in order to provide for complete combustion, and the high temperature gas mixture escapes from the flame tube through the annular orifice 8 so as to feed the turbine (not shown), which is centered on axis A—A.

In and of themselves, these various arrangements are well known, and the case of an annular combustion chamber is cited only by way of example because the invention is every bit as applicable to combustion chambers in which the flame tube is simply cylindrical in form and which are distributed in a turret-like manner around the axis A—A of the machine.

As stated in the background, the problem with which the invention is concerned is that of engendering, on those surfaces of the flame tube which are exposed to the high combustion temperature, i.e., in the case under consideration, on the inside of the external envelope 2 and on the outside face of the internal envelope 3, a homogeneously flowing cooling film whose speed is controlled by means of air taken from the high pressure space between envelopes or walls 5 and 6.

Figure 2:
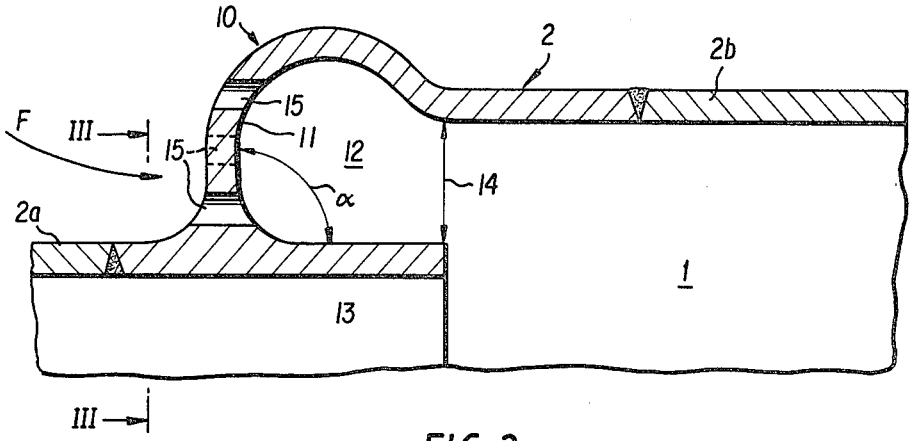
FIG. 2 is an enlarged detail in cross section of area II in FIG. 1.
Figure 3:
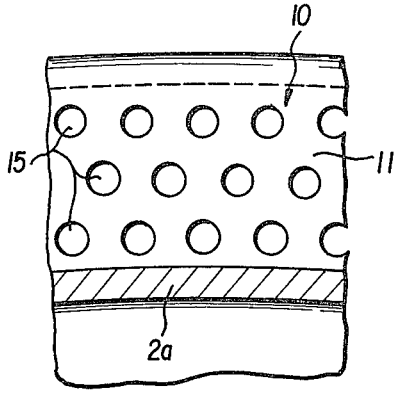
FIG. 3 is an enlarged cross section along the line III—III in the direction of the arrow F in FIG. 2. The arrow also indicates the direction of the air flow.

To do so, envelopes 2 and 3 are provided with devices, a, $a_1$, b, $b_1$, c, $c_1$, . . . one of which is shown in detail and in much larger scale in FIGS. 2 and 3, in which the scale is about 5 in relation to actual dimensions.

Each of these devices involves, extending outside the flame tube, a protuberance 10, annular in form, which interconnects two successive sleeves such as *2a, 2b,* or *3a, 3b* . . . of wall 2 or 3. This protuberance, extending outside the downstream sleeve *2b* but gradually merging into it, is connected with the upstream sleeve *2a* (the terms "upstream" and "downstream" are understood to mean in relation to the direction of flow) by means of a frontal wall portion 11 which is more or less perpendicular to that upstream sleeve. Between sleeves *2a* and *2b,* therefore, it forms a sort of annular pocket 12, which is separated from the interior of the flame tube by an extension 13 of the upstream sleeve *2a,* which here will be called the small tongue. The pocket is connected with the interior of the flame tube by an annular slot 14 which is located between the free end of the small tongue 13 and the downstream sleeve *2b,* the diameter of which is greater than that of the upstream sleeve *2a.* In the case of wall 3, the opposite is true, with a downstream sleeve such as *3b* having a smaller diameter than the upstream sleeve *3a.*

The portion of frontal wall 11 which is more or less perpendicular to the sleeve *2a* is perforated by numerous holes 15, of a relatively small diameter, which are made in a circular pattern along the periphery of that frontal portion. The holes are sufficiently small having diameters not greater than 1.5 mm to make it possible to spread them over at least three diameters, arranging the holes in an offset manner as shown in FIG. 3. In one configuration which gave good results, these holes were 1.1 mm in diameter, with an interval of 2.2 mm between the centers of two neighboring holes, while the height of the slot 14 was 4 mm.

The multiple streams of air passing through these holes rapidly slacken in speed, giving rise to a homegeneous flow escaping through slot 14 and lining the wall of the downstream sleeve *2b,* cooling it efficiently. The small tongue 13 may therefore be quite short. It has been observed that it was possible to end it at the perpendicular connection of the protuberance 10 with the downstream sleeve *2b,* as shown in FIG. 2.

The frontal arrangement of the feed holes 15 in the air flow running through the annular space 5 and 6 is conducive to obtaining a proper flow through said holes 15, despite the mediocre permeability of a surface with multiple holes, because advantage is taken of the increase in total air pressure against the frontal wall 11 and especially because the protuberance projects substantially beyond the upstream sleeve *2a,* which allows for a greater surface for perforation. Good results have been obtained with a protuberance height of the order of 1.5 to 2.5 times the height of the slot 14. As indicated previously, the frontal wall 11 will generally be perpendicular to the sleeve *2a,* and is made integrally with it. But it has been found that the angle made by wall 11 with the sleeve *2a* (angle $\alpha$ in FIG. 2) may be slightly less than 90 degrees, and vary to a lower limit of 70 degrees.

The effectiveness of the arrangement described with respect to the regular provision of the cooling film is close to that which would be obtained, in theory, with a continuous slot between two consecutuve elements of the combustion chamber wall. Variations in the flows passing through the holes 15 resulting from machining tolerances have no influence on the total flow, which flows through the exit slot 14 without any change in speed through the slot.

It goes without saying that the implementation measures described are but examples, and that they could be modified, in particular by the substitution of equivalent techniques, without in so doing departing from the context of the invention.

What is claimed as new and desired to be secured by Letters Patent of the United States is:

1. A device for cooling the wall of a combustion chamber comprising:

at least one upstream wall portion of said chamber;

at least one downstream wall portion of said chamber;

an annular protuberance disposed between and rigidly connected to each said at least one upstream wall portion and each said at least one downstream wall portion;

said protuberance further comprising a frontal wall formed about an upstream portion of said protuberance such that said frontal wall is substantially perpendicular to said at least one upstream wall portion of said chamber;

said protuberance having a plurality of holes formed therein for the intake of said cooling air and defining at least three concentric radially offset rows of said holes, said holes having diameters not greater than 1.5 mm such that said cooling air flows through said holes in a path substantially parallel to the axis of said combustion chamber;

said protuberance further defining an annular pocket;

each said at least one downstream wall portion further comprising a downstream extension forming an annular tongue;

said annular tongue defining an annular slot between an inner axial surface portion of each said at least one downstream wall and an outer axial surface portion of said annular tongue such that the radial height of said protuberance is from 1.5 to 2.5 times the radial height of said slot, said slot having a radial height from 1.5 mm to 8 mm; and said slot providing an unobstructed substantially linear flow path for said cooling air, such that said cooling air flows directly through said holes in said frontal wall, through said annular pocket, and directly through said slot.

2. Device according to claim 1 wherein the space between the centers of two neighboring holes is from 1.5 to 3 times the diameter of said holes.

3. Device according to claim 1 wherein said frontal wall of said protuberance meets said upstream wall of said chamber at an angle of between 90 and 70 degrees.

4. Device according to claim 1 wherein said annular tongue extends to the perpendicular connection of said protuberance with said downstream wall of said chamber.

* * * * *